US011455960B2

(12) United States Patent
Zhang et al.

(10) Patent No.: US 11,455,960 B2
(45) Date of Patent: Sep. 27, 2022

(54) PIXEL DRIVING CIRCUIT AND DISPLAY PANEL

(71) Applicant: SHENZHEN CHINA STAR OPTOELECTRONICS SEMICONDUCTOR DISPLAY TECHNOLOGY CO., LTD., Guangdong (CN)

(72) Inventors: Xiaodong Zhang, Guangdong (CN); Sangcheol Song, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 220 days.

(21) Appl. No.: 16/766,742

(22) PCT Filed: Apr. 29, 2020

(86) PCT No.: PCT/CN2020/087697
§ 371 (c)(1),
(2) Date: May 25, 2020

(87) PCT Pub. No.: WO2021/203497
PCT Pub. Date: Oct. 14, 2021

(65) Prior Publication Data

US 2022/0114972 A1 Apr. 14, 2022

(30) Foreign Application Priority Data

Apr. 9, 2020 (CN) ..... 202010274095.1

(51) Int. Cl.
*G09G 3/3291* (2016.01)
*G09G 3/3233* (2016.01)
(Continued)

(52) U.S. Cl.
CPC ..... *G09G 3/3291* (2013.01); *G09G 3/3233* (2013.01); *G09G 3/3258* (2013.01); *G09G 3/3266* (2013.01)

(58) Field of Classification Search
CPC .. G09G 3/3291; G09G 3/3233; G09G 3/3258; G09G 3/3266
See application file for complete search history.

(56) References Cited

U.S. PATENT DOCUMENTS

2007/0052647 A1 3/2007 Chen
2012/0249510 A1* 10/2012 Jankovic ..... G09G 3/3233 345/211

FOREIGN PATENT DOCUMENTS

CA 2438577 C 8/2006
CN 102254510 A 11/2011
(Continued)

OTHER PUBLICATIONS

□Chinese Journal of Liquid Crystals and Displays□, Pixel circuit for OLED-on-silicon microdisplay using a driving MOS transistor operated in saturation region.
(Continued)

*Primary Examiner* — Stacy Khoo
(74) *Attorney, Agent, or Firm* — PV IP PC; Wei Te Chung; Ude Lu

(57) ABSTRACT

The present invention provides a pixel driving circuit and a display panel. The pixel driving circuit includes a light emitting module and a compensation driving module which are electrically connected. The compensation driving module includes a doubled-gate driving thin film transistor, and is configured to charge a bottom gate of the doubled-gate driving thin film transistor and adjust a threshold voltage to an initial value in an initial stage. The compensation driving module receives a reference voltage to discharge the bottom
(Continued)

gate of the doubled-gate driving thin film transistor in a threshold voltage compensation, realizing a compensation of the threshold voltage.

20 Claims, 5 Drawing Sheets

(51) Int. Cl.
*G09G 3/3258* (2016.01)
*G09G 3/3266* (2016.01)

(56) References Cited

FOREIGN PATENT DOCUMENTS

| | | | |
|---|---|---|---|
| CN | 102842283 | A | 12/2012 |
| CN | 103065586 | A | 4/2013 |
| CN | 104134680 | A | 11/2014 |
| CN | 105741781 | A | 7/2016 |
| CN | 107424563 | A | 12/2017 |
| CN | 107591126 | A | 1/2018 |
| JP | 4161373 | B2 | 10/2008 |
| JP | 2011112722 | A | 6/2011 |
| JP | 4748456 | B2 | 8/2011 |
| KR | 20130046149 | A | 5/2013 |
| KR | 20140080728 | A | 7/2014 |

OTHER PUBLICATIONS

□Chinese Journal of Liquid Crystals and Displays□, Pixel Design of Organic Thin Film Transistor Array.

* cited by examiner

PIXEL DRIVING CIRCUIT AND DISPLAY PANEL

RELATED APPLICATIONS

This application is a Notional Phase of PCT Patent Application No. PCT/CN2020/087697 having international filing date of Apr. 29, 2020, which claims the benefit of priority of Chinese Patent Application No. 202010274095.1 filed on Apr. 9, 2020. The contents of the above applications are all incorporated by reference as if fully set forth herein in their entirety.

FIELD OF INVENTION

The present disclosure relates to the field of display technology, and more particularly, to a pixel driving circuit and a display panel.

BACKGROUND OF INVENTION

Compared with liquid crystal display (LCD) technology, organic light-emitting diode (OLED) displays have advantages of higher contrast, faster response speed, and wide viewing angle, and are widely applied in a field of smart phones, smart TVs, and wearable devices. However, OLEDs are organic materials which are sensitive to water, oxygen, etc., affecting material stability and lifespan of the displays. In recent years, micro light-emitting diodes (micro-LEDs) made of inorganic materials have attracted extensive attention due to their advantages of high contrast and high stability of inorganic materials, and are considered to be a new display technology comparable to OLEDs in the future.

Traditional LCDs are voltage-driven devices, while micro-LEDs and OLEDs are current-driven devices that are sensitive to electrical variations in thin film transistors (TFTs). Therefore, uniformity of a threshold voltage Vth of the thin film transistors of micro-LED and OLED display panels, and a positive or negative drift of the threshold voltage Vth under electrical stress (Stress) will affect accuracy and uniformity of images displayed. In order to solve the drift problem of the threshold voltage Vth, a compensation circuit design is usually used.

FIG. 1(*a*) is a structure of traditional diode-connect (diode structure) type internal compensation circuit, wherein a T1 thin film transistor is a driving thin film transistor, and the T1 thin film transistor is an N-type thin film transistor (NTFT), and a T2 thin film transistor is a switch thin film transistor. A source and a drain of the T2 thin film transistor are respectively connected to a gate (G) and a drain (D) of the T1 thin film transistor. When the T2 thin film transistor is turned on, the T1 thin film transistor forms the diode structure. As shown in FIG. 1(*b*), if a threshold voltage Vth of the T1 thin film transistor is greater than 0V, a voltage of the gate (G) of the T1 thin film transistor will be discharged through diodes until a voltage difference Vgs between the gate (G) and a source (S) of the T1 thin film transistor is equal to the threshold voltage Vth, and the diodes are turned off. Thus, a threshold voltage Vth information of the T1 thin film transistor is detected, which is configured to further compensate the threshold voltage Vth. However, as shown in FIG. 1(*c*), if the threshold voltage Vth of the T1 thin film transistor is less than 0V, the T1 thin film transistor is turned on until potentials of the gate (G) and the source (S) are equal, namely the voltage difference Vgs is 0V. Thus, the gate (G) cannot fully detect the threshold voltage Vth information and cannot further compensate the threshold voltage Vth. Therefore, for N-type thin film transistors, the traditional diode-connect type compensation circuit cannot compensate for a negative Vth, which is inconducive to improving display uniformity of panels, and reduces the lifespan of the panels.

Therefore, a new pixel driving circuit is necessarily to be provided to realize compensation for the threshold voltage Vth being positive and negative, thereby improving accuracy and uniformity of images displayed.

SUMMARY OF INVENTION

The present disclosure provides a pixel driving circuit and a display panel, which combine a gate regulation principle of doubled-gate devices and a threshold voltage detection principle of diode structures to realize compensation for a threshold voltage of driving thin film transistors being positive and negative, so that a problem that traditional diode-connect type internal compensation circuit can only compensate for a threshold voltage drift in a single direction is solved, thereby improving accuracy and uniformity of images displayed.

In a first aspect, the present disclosure provides a pixel driving circuit comprising a light-emitting module and a compensation driving module. The light-emitting module is configured to receive a first low power source voltage (EVDD) in an initial stage, a threshold voltage compensation stage, and a data writing stage. The light-emitting module receives a first high power source voltage (EVDD) in a light-emitting stage.

The compensation driving module is electrically connected to the light-emitting module, comprises a doubled-gate driving thin film transistor, and is configured to receive a high potential signal to turn on the doubled-gate driving thin film transistor, and receive a second high power source voltage to charge a bottom gate of the doubled-gate driving thin film transistor to adjust a threshold voltage of the doubled-gate driving thin film transistor to an initial value in the initial stage. The compensation driving module receives a reference voltage to turn on the doubled-gate driving thin film transistor, and receives a second low power source voltage to discharge the bottom gate of the doubled-gate driving thin film transistor, and compensates the threshold voltage of the doubled-gate driving thin film transistor to be equal to a voltage difference between the reference voltage and the second low power source voltage in the threshold voltage compensation stage. The compensation driving module receives a data signal and the second low power source voltage in the data writing stage. The doubled-gate driving thin film transistor is turned on, and the compensation driving module receives the second low power source voltage to control the light-emitting module to emit light in the light-emitting stage.

In the pixel driving circuit provided by the present disclosure, the compensation driving module further comprises a first switch thin film transistor and a second switch thin film transistor.

The compensation driving module is further configured to turn on the first switch thin film transistor to receive the high potential signal, and turn on the second switch thin film transistor so that the second high power source voltage charges the bottom gate of the doubled-gate driving thin film transistor in the initial stage. The compensation driving module turns on the first switch thin film transistor to receive the reference voltage, and turns on the second switch thin film transistor to discharge the bottom gate of the doubled-gate driving thin film transistor in the threshold voltage compensation stage. The compensation driving module turns off the first switch thin film transistor and the second switch thin film transistor to receive the data signal in the data writing stage. The compensation driving module turns off the first switch thin film transistor and the second switch thin film transistor to drive the second switch thin film transistor to emit light in the light-emitting stage.

In the pixel driving circuit provided by the present disclosure, a source of the doubled-gate driving thin film transistor receives the second power source voltage, and a drain of the doubled-gate driving thin film transistor is electrically connected to the light-emitting module. A gate of the first switch thin film transistor receives a first control signal, a source of the first switch thin film transistor receives the high potential signal in the initial stage and receives the reference voltage in the threshold voltage compensation stage, and a drain of the first switch thin film transistor is electrically connected to a top gate of the doubled-gate driving thin film transistor. A gate of the second switch thin film transistor receives the first control signal, a source of the second switch thin film transistor is electrically connected to the drain of the doubled-gate driving thin film transistor and a drain of the second switch thin film transistor is electrically connected to the bottom gate of the doubled-gate driving thin film transistor.

In the pixel driving circuit provided by the present disclosure, the compensation driving module further comprises a first capacitor and a second capacitor. One end of the first capacitor is electrically connected to the top gate of the doubled-gate driving thin film transistor and the other end of the first capacitor is electrically connected to the source of the doubled-gate driving thin film transistor, which are configured to store a potential of the top gate of the doubled-gate driving thin film transistor. One end of the second capacitor is electrically connected to the bottom gate of the doubled-gate driving thin film transistor, and the other end of the second capacitor is grounded, which are configured to store a potential of the bottom gate of the doubled-gate driving thin film transistor.

In the pixel driving circuit provided by the present disclosure, the reference voltage is a positive voltage or a negative voltage.

In the pixel driving circuit provided by the present disclosure, the doubled-gate driving thin film transistor is one of an N-type oxide thin film transistor, an N-type low-temperature polysilicon thin film transistor, an N-type amorphous silicon thin film transistor, or an N-type organic thin film transistor.

In the pixel driving circuit provided by the present disclosure, the pixel driving circuit further comprises a data writing module electrically connected to the compensation driving module. The data writing module is configured to obtain the data signal and output the data signal to the compensation driving module in the data writing stage.

In the pixel driving circuit provided by the present disclosure, the data writing module comprises a third switch thin film transistor, a gate of the third switch thin film transistor receives a second control signal, a source of the third switch thin film transistor receives the data signal, and a drain of the third switch thin film transistor is electrically connected to a top gate of the doubled-gate driving thin film transistor.

In the pixel driving circuit provided by the present disclosure, each of a first switch thin film transistor, a second switch thin film transistor, and the third switch thin film transistor is one of an N-type thin film transistor or a P-type thin film transistor.

In the pixel driving circuit provided by the present disclosure, the pixel driving circuit further comprises a data writing module electrically connected to the compensation driving module. The data writing module is configured to output a pre-stored data signal to the compensation driving module in the data writing stage, and to obtain and store a data signal needed for a next frame in the light-emitting stage.

In the pixel driving circuit provided by the present disclosure, the data writing module comprises a third switch thin film transistor, a fourth switch thin film transistor, and a third capacitor. The data writing module is configured to turn off the third switch thin film transistor, turn on the fourth switch thin film transistor, and output a data signal pre-stored in the third capacitor to a top gate of the doubled-gate driving thin film transistor in the data writing stage. The data writing module turns off the fourth switch thin film transistor and turns on the third switch thin film transistor to obtain the data signal of the next frame and store thereof in the third capacitor in the light-emitting stage.

In the pixel driving circuit provided by the present disclosure, a gate of the third switch thin film transistor receives a second control signal, a source of the third switch thin film transistor receives the data signal, and a drain of the third switch thin film transistor is electrically connected to a source of the fourth switch thin film transistor. A gate of the fourth switch thin film transistor receives a third control signal, and a drain of the fourth switch thin film transistor is electrically connected to a top gate of the doubled-gate driving thin film transistor. One end of the third capacitor is electrically connected to the source of the fourth switch thin film transistor, and the other end of the third capacitor is grounded.

In the pixel driving circuit provided by the present disclosure, each of a first switch thin film transistor, a second switch thin film transistor, the third switch thin film transistor, and the fourth switch thin film transistor is one of an N-type thin film transistor or a P-type thin film transistor.

In the pixel driving circuit provided by the present disclosure, the light-emitting module comprises an organic light-emitting diode (OLED) light-emitting device or a micro light-emitting diode (Micro-LED) light-emitting device.

In a second aspect, the present disclosure further provides a display panel comprising a signal control unit and a plurality of pixel units. Each pixel units comprises the above pixel driving circuit. The signal control unit is electrically connected to each pixel driving circuits to provide a control signal for the pixel driving circuit.

In the display panel provided by the present disclosure, the compensation driving module further comprises a first switch thin film transistor and a second switch thin film transistor.

The compensation driving module is further configured to turn on the first switch thin film transistor to receive the high potential signal, and turn on the second switch thin film transistor so that the second high power source voltage charges the bottom gate of the doubled-gate driving thin film transistor in the initial stage. The compensation driving module turns on the first switch thin film transistor to receive the reference voltage, and turns on the second switch thin film transistor to discharge the bottom gate of the doubled-gate driving thin film transistor in the threshold voltage compensation stage. The compensation driving module turns off the first switch thin film transistor and the second switch thin film transistor to receive the data signal in the data writing stage. The compensation driving module turns off the first switch thin film transistor and the second switch thin film transistor to drive the second switch thin film transistor to emit light in the light-emitting stage.

In the display panel provided by the present disclosure, a source of the doubled-gate driving thin film transistor receives the second power source voltage, and a drain of the doubled-gate driving thin film transistor is electrically connected to the light-emitting module. A gate of the first switch thin film transistor receives a first control signal, a source of the first switch thin film transistor receives the high potential signal in the initial stage and receives the reference voltage in the threshold voltage compensation stage, and a drain of the first switch thin film transistor is electrically connected to a top gate of the doubled-gate driving thin film transistor. A gate of the second switch thin film transistor receives the first control signal, a source of the second switch thin film transistor is electrically connected to the drain of the doubled-gate driving thin film transistor and a drain of the second switch thin film transistor is electrically connected to the bottom gate of the doubled-gate driving thin film transistor.

In the display panel provided by the present disclosure, the compensation driving module further comprises a first capacitor and a second capacitor. One end of the first capacitor is electrically connected to the top gate of the doubled-gate driving thin film transistor and the other end of the first capacitor is electrically connected to the source of the doubled-gate driving thin film transistor, which are configured to store a potential of the top gate of the doubled-gate driving thin film transistor. One end of the second capacitor is electrically connected to the bottom gate of the doubled-gate driving thin film transistor, and the other end of the second capacitor is grounded, which are configured to store a potential of the bottom gate of the doubled-gate driving thin film transistor.

In the display panel provided by the present disclosure, the pixel driving circuit further comprises a data writing module electrically connected to the compensation driving module. The data writing module is configured to obtain the data signal and output the data signal to the compensation driving module in the data writing stage.

In the display panel provided by the present disclosure, the reference voltage is a positive voltage or a negative voltage.

Compared with the prior art, in the pixel driving circuit provided by the present disclosure, the driving thin film transistor in the compensation driving module adopts a doubled-gate structure. According to the gate regulation principle of doubled-gate devices, a potential of the bottom gate of the doubled-gate driving thin film transistor can linearly dynamically adjust the threshold voltage. In the initial stage, the bottom gate of the doubled-gate driving thin film transistor is charged to a high potential, and the threshold voltage is adjusted to a lower initial value. Then, combined the threshold voltage detection principle of diode structures, in the threshold voltage compensation stage, the bottom gate and the drain of the doubled-gate driving thin film transistor are short-circuited to form a diode structure, thereby gradually decreasing a high potential of the bottom gate until the doubled-gate driving thin film transistor is turned off, so that the threshold voltage is equal to the voltage difference between the top gate and the source of the doubled-gate driving thin film transistor. Since the potential of the top gate is equal to the reference voltage and the potential of the source is equal to the second power source voltage in this stage, the threshold voltage after compensation is equal to a difference between the reference voltage and the second power source voltage in the compensation stage, thereby realizing a compensation of the threshold voltage of the doubled-gate driving thin film transistor. In addition, regardless of whether the threshold voltage of the doubled-gate driving thin film transistor is positive or negative before initialization, the threshold voltage of the doubled-gate driving thin film transistor can be adjusted to the initial value by increasing the potential of the bottom gate of the doubled-gate driving thin film transistor and then compensate thereof. Therefore, the pixel driving circuit of the present disclosure can realize the compensation for the threshold voltage being positive and negative, effectively broadening a compensation range of the threshold voltage, which solves the problem that traditional diode-connect type internal compensation circuit can only compensate for the threshold voltage drift in a single direction, and is beneficial to improve display accuracy and display uniformity of the display panels and lifespan of the display panels.

DESCRIPTION OF DRAWINGS

The following describes specific embodiment of the present disclosure in detail with reference to drawings, which will make the technical solutions and other beneficial effects of the present disclosure obvious.

FIG. 1 (*b*) is a schematic diagram showing a change of a voltage difference between a gate and a source of a T1 thin film transistor when the internal compensation circuit structure in FIG. 1 (*a*) is configured to detect a positive threshold voltage.

FIG. 1(*c*) is a schematic diagram showing the change of the voltage difference between the gate and the source of a T1 thin film transistor when the internal compensation circuit structure in FIG. 1 (*a*) is configured to detect a negative threshold voltage.

DETAILED DESCRIPTION OF PREFERRED EMBODIMENTS

The technical solutions in the embodiments of the present disclosure will be clearly and completely described below in conjunction with accompanying drawings in the embodiments of the present disclosure. Obviously, the embodiments described are merely a part of the present disclosure, rather than all the embodiments. All other embodiments obtained by the person having ordinary skill in the art based on embodiments of the disclosure, without making creative efforts, are within the scope of the present disclosure.

The following disclosure provides many different embodiments or examples for achieving different structures of the present disclosure. To simplify the present disclosure, components and settings of specific examples are described below. They are only examples and are not intended to limit the present disclosure. In addition, the present disclosure may repeat reference numbers and/or reference letters in different examples, this repetition is for the purpose of simplicity and clarity, and does not itself indicate the relationship between various embodiments and/or settings discussed. In addition, the present disclosure provides examples of various specific processes and materials, but those of ordinary skill in the art may be aware of the present disclosure of other processes and/or the use of other materials.

Figure 1A:
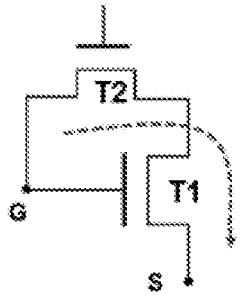
FIG. 1(*a*) is a schematic structural diagram of an internal compensation circuit structure of an exemplary diode structure type.
Figure 1B:
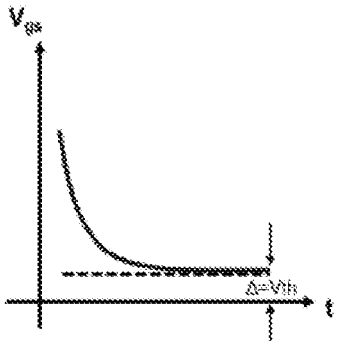
Figure 1C:
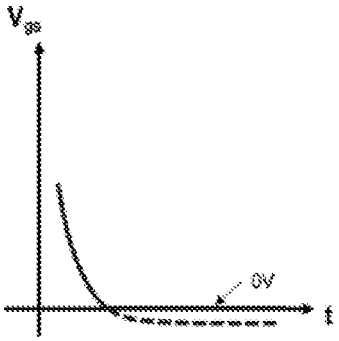
Figure 2:
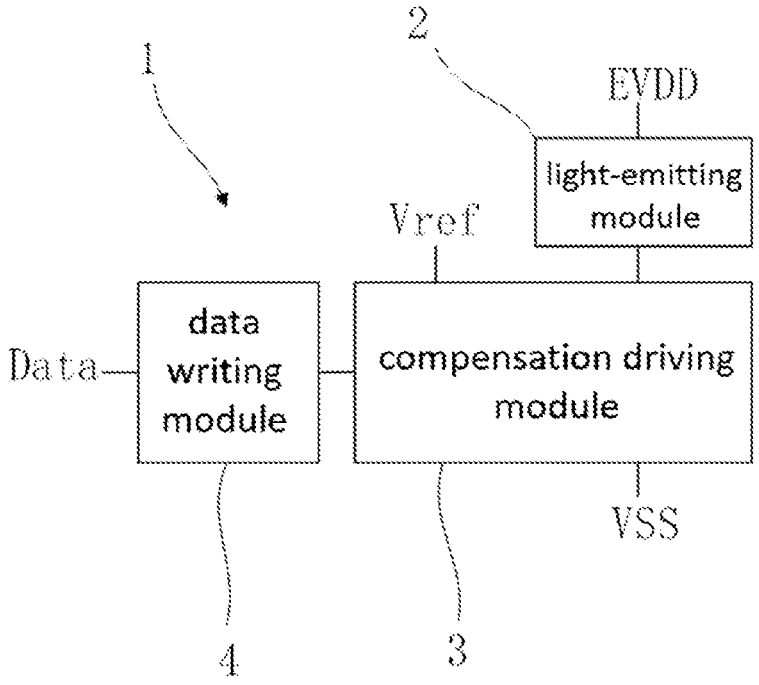
FIG. 2 is a schematic structural block diagram of a pixel driving circuit provided by an embodiment of the present disclosure.
Figure 3:
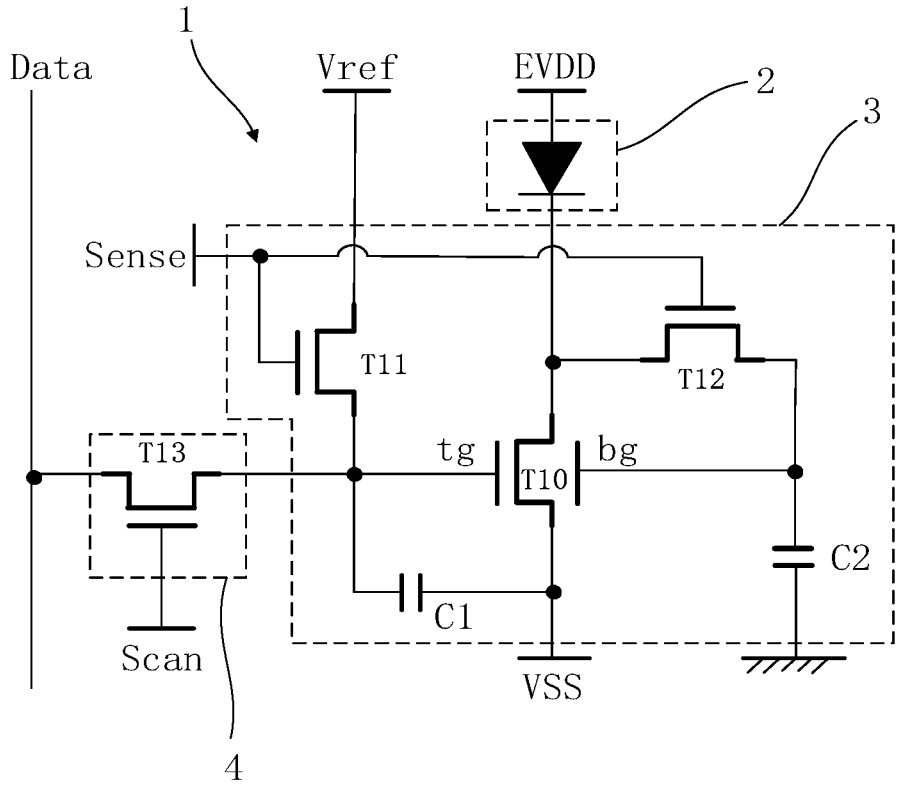
FIG. 3 is a circuit diagram of a pixel driving circuit of a 4T2C architecture provided by the embodiment of the present disclosure.

As shown in FIG. 2 and FIG. 3, an embodiment of the present disclosure provides a pixel driving circuit 1 of a 4T2C architecture, the pixel driving circuit 1 comprises a light-emitting module 2, a compensation driving module 3, and a data writing module 4, and a driving timing of the pixel driving circuit 1 comprises an initial stage, a threshold voltage compensation stage, a data writing stage, and a light-emitting stage in sequence.

The light-emitting module 2 is configured to receive a first low power source voltage EVDD in the initial stage, the threshold voltage compensation stage, and the data writing stage to maintain a non-light-emitting stage, and receive a first high power source voltage EVDD to emit light in the light-emitting stage. Specifically, the light-emitting module 2 comprises an organic light-emitting diode (OLED) light-emitting device or a micro light-emitting diode (micro-LED) light-emitting device, an anode of the light-emitting device receive the first power voltage EVDD, and a cathode of the light-emitting device is electrically connected to the compensation driving module 3.

The data writing module 4 electrically connected to the compensation driving module 3 is configured to obtain a data signal and output the data signal to the compensation driving module 3 in the data writing stage.

The compensation driving module 3 is further electrically connected to the light-emitting module 2. The compensation driving module 3 comprises a doubled-gate driving thin film transistor T10, and is configured to receive a high potential signal to turn on the doubled-gate driving thin film transistor T10, and receive a second high power source voltage VSS to charge a bottom gate bg of the doubled-gate driving thin film transistor T10 to adjust a threshold voltage Vth of the doubled-gate driving thin film transistor T10 to an initial value in the initial stage. The compensation driving module 3 receives a reference voltage Vref (greater than the above initial value and less than the above high potential signal) to turn on the doubled-gate driving thin film transistor T10, and receives a second low power source voltage VSS to discharge the bottom gate bg of the doubled-gate driving thin film transistor T10, and compensates the threshold voltage Vth of the doubled-gate driving thin film transistor T10 to be equal to a voltage difference (Vref−VSS) between the reference voltage Vref and the second low power source voltage VSS in the threshold voltage compensation stage. The compensation driving module 3 receives a data signal Data provided by the data writing module 4 in the data writing stage. The doubled-gate driving thin film transistor T10 is turned on through the data signal Data, and the compensation driving module 3 receives the second low power source voltage VSS to control the light-emitting module 2 to emit light in the light-emitting stage.

Specifically, a top gate tg of the doubled-gate driving thin film transistor T10 receives a high potential signal in the initial stage, and receives the reference voltage Vref in the threshold voltage compensation stage, a source of the doubled-gate driving thin film transistor T10 receives the second power source voltage VSS, and a drain of the doubled-gate driving thin film transistor T10 is electrically connected to the cathode of the light-emitting devices in the light emitting module 2. The doubled-gate driving thin film transistor T10 is one of an N-type oxide thin film transistor, an N-type low-temperature polysilicon thin film transistor, an N-type amorphous silicon thin film transistor, or an N-type organic thin film transistor.

It should be noted that since the doubled-gate driving thin film transistor T10 has a doubled-gate structure, the threshold voltage Vth is not a fixed value, and the threshold voltage Vth and a potential of the bottom gate bg are a negative linear relationship. Specifically, the threshold voltage Vth of the doubled-gate driving thin film transistor T10 decreases linearly as a voltage difference (Vbgs) between the bottom gate bg and the source of the doubled-gate driving thin film transistor T10 increases. Moreover, for the doubled-gate driving thin film transistor T10 of different sizes, a slope of a linear relationship between the threshold voltage Vth and the voltage difference Vbgs is equal, that is, the doubled-gate driving thin film transistors T10 of different sizes are all within a protection scope of the present disclosure.

Specifically, in the initial stage, the bottom gate bg of the doubled-gate driving thin film transistor T10 is charged to the high potential, so that the threshold voltage Vth drops to the lower initial value. In the threshold voltage compensation stage, the bottom gate bg of the doubled-gate driving thin film transistor T10 is discharged, and in a process of a high potential of the bottom gate bg gradually decreasing, the threshold voltage Vth gradually increases until it is equal to a voltage difference Vtgs between the top gate tg and the source of the doubled-gate driving thin film transistor T10. Meanwhile, the doubled-gate driving thin film transistor T10 is turned off, thereby completing the threshold voltage compensation. Since in a threshold voltage compensation process, the top gate tg of the doubled-gate driving thin film transistor T10 receives the reference voltage Vref, and the drain of the doubled-gate driving thin film transistor T10 receives the second low power source voltage VSS, a compensated threshold voltage Vth=Vtgs=Vref−VSS, the second low power source voltage VSS can be set to 0V. Therefore, the compensated threshold voltage Vth=Vref. The threshold voltage after compensation is obtained by setting the reference voltage Vref.

Specifically, the reference voltage Vref is a positive voltage or a negative voltage. It should be noted that a value of the reference voltage Vref depends on a threshold voltage Vth distribution before the display panel is not initialized, and is not a fixed value. The threshold voltage Vth of general oxide thin film transistors (TFTs) is about 0V before being initialized. Since the threshold voltage Vth will drift positively and negatively, for oxide TFTs, the reference voltage Vref selected in the threshold voltage compensation stage is negative. Moreover, for TFTs with the threshold voltage Vth greater than 0V before being initialized, the reference voltage Vref can be set to a positive value. Therefore, the pixel driving circuit 1 provided by the embodiment of the present disclosure can compensate the threshold voltage Vth being positive, and can also compensate the threshold voltage Vth being negative.

Specifically, the compensation driving module 3 further comprises a first switch thin film transistor T11, a second switch thin film transistor T12, a first capacitor C1, and a second capacitor C2.

A gate of the first switch thin film transistor T11 receives a first control signal Sense, a source of the first switch thin film transistor T11 receives the high potential signal in the initial stage and receives the reference voltage Vref in the threshold voltage Vth compensation stage, and a drain of the first switch thin film transistor T11 is electrically connected to the top gate tg of the doubled-gate driving thin film transistor T10. It should be noted that the reference voltage Vref shown in FIG. 2 and FIG. 3 can also be replaced by the above high potential signal.

Agate of the second switch thin film transistor T12 also receives the first control signal Sense, a source of the second switch thin film transistor T12 is electrically connected to the drain of the doubled-gate driving thin film transistor T10, and a drain of the second switch thin film transistor T12 is electrically connected to the bottom gate bg of the doubled-gate driving thin film transistor T10.

One end of the first capacitor C1 is electrically connected to the top gate tg of the doubled-gate driving thin film transistor T10, and the other end of the first capacitor C1 is electrically connected to the source of the doubled-gate driving thin film transistor T10, which are configured to store a potential of the top gate tg of the doubled-gate driving thin film transistor T10. One end of the second capacitor C2 is electrically connected to the bottom gate bg of the doubled-gate driving thin film transistor T10, and the other end of the second capacitor C2 is grounded, which is configured to store a potential of the bottom gate bg of the doubled-gate driving thin film transistor T10.

Specifically, the compensation driving module 3 is further configured to turn on the first switch thin film transistor T11 through the first control signal Sense so that the top gate tg of the doubled-gate driving thin film transistor T10 receives the high potential signal to be turned on, and turn on the second switch thin film transistor T12 through the first control signal Sense so that the bottom gate bg and the drain of the doubled-gate driving thin film transistor T10 are short-circuited to form a diode structure in the initial stage. Therefore, the second high power source voltage VSS sequentially charges the bottom gate bg of the doubled-gate driving thin-film transistor T10 through the doubled-gate driving thin-film transistor T10 and the second switch thin film transistor T12 to realize an initialization of the threshold voltage of the doubled-gate driving thin film transistor T10. Moreover, the compensation driving module turns on the first switch thin film transistor T11 through the first control signal Sense so that the top gate tg of the doubled-gate driving thin film transistor T10 receives the reference voltage Vref, and turns on the second switch thin film transistor T12 through the first control signal Sense to maintain the bottom gate bg and the drain of the doubled-gate driving thin film transistor T10 shorted in the threshold voltage compensation stage. Meanwhile, the source of the doubled-gate driving thin film transistor T10 receives the second low power source voltage VSS to discharge the bottom gate bg of the doubled-gate driving thin film transistor T10 to realize a compensation of the threshold voltage of the doubled-gate driving thin film transistor T10. The compensation driving module turns off the first switch thin film transistor T11 and the second switch thin film transistor T12 through the first control signal Sense to receive the data signal Data and store into the first capacitor C1 in the data writing stage. The compensation driving module turns off the first switch thin film transistor T11 and the second switch thin film transistor T12 through the first control signal Sense, and the doubled-gate driving thin film transistor T10 is turned on through the data signal Data stored in the first capacitor C1, to drive light-emitting module 2 to emit light in the light-emitting stage.

Specifically, the data writing module 4 comprises a third switch thin film transistor T13, a gate of the third switch thin film transistor T13 receives a second control signal Scan, a source of the third switch thin film transistor T13 receives the data signal Data, and a drain of the third switch thin film transistor T13 is electrically connected to the top gate tg of the doubled-gate driving thin film transistor T10. The data writing module 4 is configured to turn off the third switch thin film transistor T13 through the second control signal Scan in the initial stage, the threshold voltage compensation stage, and the light-emitting stage, and turn on the third switch thin film transistor T13 through the second control signal Scan in data writing stage to obtain the data signal Data and output the data signal Data to the top gate tg of the doubled-gate driving thin film transistor T10 in the data writing stage.

Specifically, the first switch thin film transistor T11, the second switch thin film transistor T12, and the third switch thin film transistor T13 may be either N-type thin film transistors or P-type thin film transistors. According to different material types, the first switch thin film transistor T11, the second switch thin film transistor T12, and the third switch thin film transistor T13 comprise one of an oxide thin film transistor, a low temperature polysilicon thin film transistor, an amorphous silicon thin film transistor, or an organic thin film transistor. Moreover, the first switch thin film transistor T11, the second switch thin film transistor T12, and the third switch thin film transistor T13 may be either a single gate structure or a doubled-gate structure, which is not limited here.

Specifically, when the first switch thin film transistor T11, the second switch thin film transistor T12, and the third switch thin film transistor T13 are N-type thin-film transistors, the first switch thin film transistor T11, the second switch thin film transistor T12, and the third switch thin film transistor T13 are respectively turned on through high potential control signals and turned off through low potential control signals. When the first switch thin film transistor T11, the second switch thin film transistor T12, and the third switch thin film transistor T13 are P-type thin-film transistors, the first switch thin film transistor T11, the second switch thin film transistor T12, and the third switch thin film transistor T13 are respectively turned on through the low potential control signals and turned off through the high potential control signals.

Figure 4:
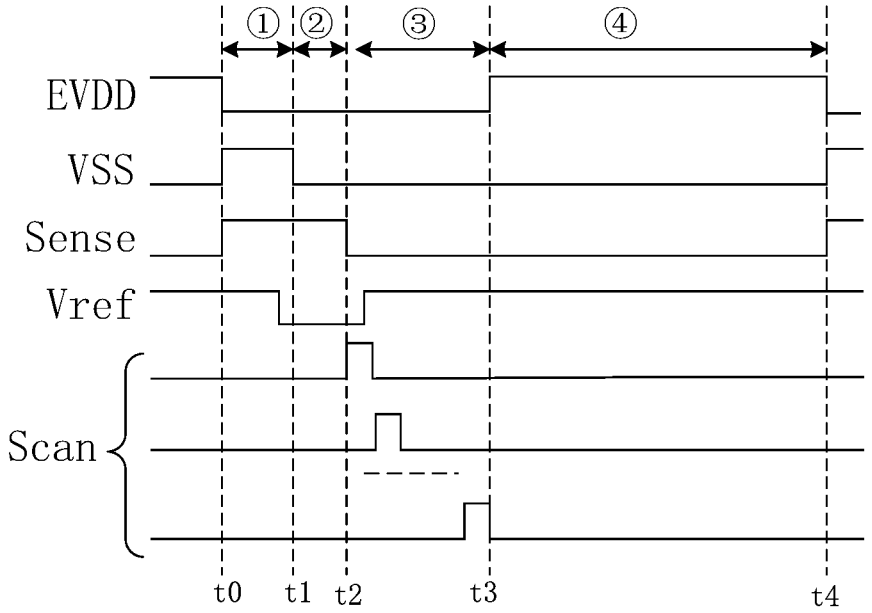
FIG. 4 is a driving timing diagram of the pixel driving circuit provided in FIG. 3.

In one embodiment, a driving timing of the pixel driving circuit 1 is shown in FIG. 4, the driving timing of the pixel driving circuit 1 is the initial stage (1), the threshold voltage compensation stage (2), the data writing stage (3), and the light-emitting stage (4) in sequence. It should be noted that since the source of the first switch thin film transistor T11 receives both the high potential signal in the initial stage (1) and the reference voltage Vref in the threshold voltage compensation stage (2), in the timing diagram, the high potential signal and the reference voltage Vref are indicated by a same potential line Vref, and the high potential signal is considered to be an initial voltage, the reference voltage Vref is considered to be a specific reference voltage in the compensation stage.

Combined FIG. 3 and FIG. 4, driving steps of the pixel driving circuit 1 are as follows:

The initial stage: the first power source voltage EVDD is the low potential, the second power source voltage VSS is the high potential, the first control signal Sense is the high potential, the first switch thin film transistor T11 and the second switch thin film transistor T12 are turned on, the second control signal Scan is the low potential, and the third switch thin film transistor T13 is turned off. The top gate tg of the doubled-gate driving thin film transistor T10 receives a high potential signal, so that the doubled-gate driving thin film transistor T10 is turned on, and the bottom gate bg and the drain of the doubled-gate driving thin film transistor T10 are short-circuited to form the diode structure. The second power source voltage VSS of the high potential charges the bottom gate bg of the doubled-gate driving thin film transistor T10 to the high potential. When the second power source voltage VSS drops from the high potential to the low potential, the threshold voltage Vth is adjusted to the lower initial value, and the second capacitor C2 stores the high potential of the bottom gate bg of the doubled-gate driving thin film transistor T10.

The threshold voltage compensation stage: the first power source voltage EVDD is a low potential, the second power source voltage VSS is a low potential, the first control signal Sense is a high potential, the first switch thin film transistor T11 and the second switch thin film transistor T12 are turned on, the second control signal Scan is a low potential, and the third switch thin film transistor T13 is turned off. The top gate tg of the doubled-gate driving thin film transistor T10 receives the reference voltage Vref, so that the doubled-gate driving thin film transistor T10 is turned on, and the bottom gate bg and the drain of the doubled-gate driving thin film transistor T10 are short-circuited to form a diode structure. The high potential of the bottom gate bg of the doubled-gate driving thin film transistor T10 gradually decreases until the doubled-gate driving thin film transistor T10 is turned off (cut off) that completes the compensation of the threshold voltage Vth. Moreover, the compensated threshold voltage Vth=Vref−VSS=Vref−0V=Vref, the second capacitor C2 stores a low potential of the bottom gate bg to maintain the threshold voltage Vth as a compensation value.

The data writing stage: the first power source voltage EVDD is a low potential, the second power source voltage VSS is a low potential, the first control signal Sense is a low potential, the first switch thin film transistor T11 and the second switch thin film transistor T12 are turned off, the second control signal Scan is a high potential (Scan progressively turn on in rows), and the third switch thin film transistor T13 is turned on. The data signal Data is written from a data line and output to the top gate tg of the doubled-gate driving thin film transistor T10 through the third switch thin film transistor T13, and stored in the first capacitor C1.

The light-emitting stage: the first power source voltage EVDD is a high potential, the second power source voltage VSS is a low potential, the first control signal Sense is a low potential, the first switch thin film transistor T11 and the second switch thin film transistor T12 are turned off, the second control signal Scan is a low potential, and the third switch thin film transistor T13 is turned off. The data signal Data stored in the first capacitor C1 controls the doubled-gate driving thin film transistor T10 to be turned on to drive the light-emitting module 2 to emit light.

Specifically, in the light-emitting stage, a formula for current passing through the light-emitting devices is:

$$I = K(\alpha V_{Data} - Vth)^2$$
$$= K(\alpha V_{Data} - Vref)^2$$

Wherein, K is a constant coefficient related to characteristics of the doubled-gate driving thin film transistor T10, α is efficiency of the data signal Data transmitted to the top gate tg of the doubled-gate driving thin film transistor T10, and Vref is the reference voltage in the threshold voltage compensation stage.

According to the above current formula, a current value passing through the doubled-gate driving thin film transistor T10 and the light-emitting module 2 is independent of the threshold voltage Vth of the doubled-gate driving thin film transistor T10, and a threshold voltage drift of the doubled-gate driving thin film transistor T10 is compensated, which is beneficial in improving display uniformity and display accuracy of display panels.

It should be noted that in order to prevent the second power voltage VSS from dropping from a high potential to a low potential at a t1 time point causing a decrease in the high potential in the second capacitor C2, the high potential signal of the top gate tg of the doubled-gate driving thin film transistor T10 drops earlier than the second power source voltage VSS to turn off the doubled-gate driving thin film transistor T10 to maintain an initial effect. Moreover, in order to ensure that the compensated threshold voltage is not affected, the reference voltage Vref is delayed until it rises to a high potential signal in the data writing stage, which prevent simultaneously changing with the first control signal Sense at a t2 time.

In the present embodiment, a driving thin film transistor in the compensation driving module 3 adopts a doubled-gate structure, namely the doubled-gate driving thin film transistor T10. According to a gate regulation principle of doubled-gate devices, a potential of the bottom gate bg of the doubled-gate driving thin film transistor T10 can linearly dynamically adjust the threshold voltage. In the initial stage, the bottom gate bg of the doubled-gate driving thin film transistor T10 is charged to a high potential, and the threshold voltage Vth is adjusted to the lower initial value. Then, combined a threshold voltage detection principle of diode structures, in the threshold voltage compensation stage, the bottom gate bg and the drain of the doubled-gate driving thin film transistor T10 are short-circuited to form a diode structure, thereby gradually decreasing a high potential of the bottom gate bg until the doubled-gate driving thin film transistor T10 is turned off, so that the threshold voltage Vth is equal to the voltage difference between the top gate tg and the source of the doubled-gate driving thin film transistor T10. Since the potential of the top gate tg is equal to the reference voltage Vref and the potential of the source is equal to the second power source voltage VSS in this stage, the threshold voltage after compensation is equal to a difference between the reference voltage Vref and the second power source voltage VSS in the compensation stage, thereby realizing a compensation of the threshold voltage of the doubled-gate driving thin film transistor T10. In addition, regardless of whether the threshold voltage Vth of the doubled-gate driving thin film transistor T10 is positive or negative before initialization, the threshold voltage Vth of the doubled-gate driving thin film transistor T10 can be adjusted to the initial value by increasing the potential of the bottom gate bg of the doubled-gate driving thin film transistor T10 and then compensate thereof. Therefore, the pixel driving circuit 1 of the present disclosure can realize the compensation for the threshold voltage Vth being positive and negative, effectively broadening a compensation range of the threshold voltage Vth, which solves the problem that traditional diode-connect type internal compensation circuit can only compensate for the threshold voltage drift in a single direction, and is beneficial to improve display accuracy and display uniformity of the display panels and lifespan of the display panels.

Figure 5:
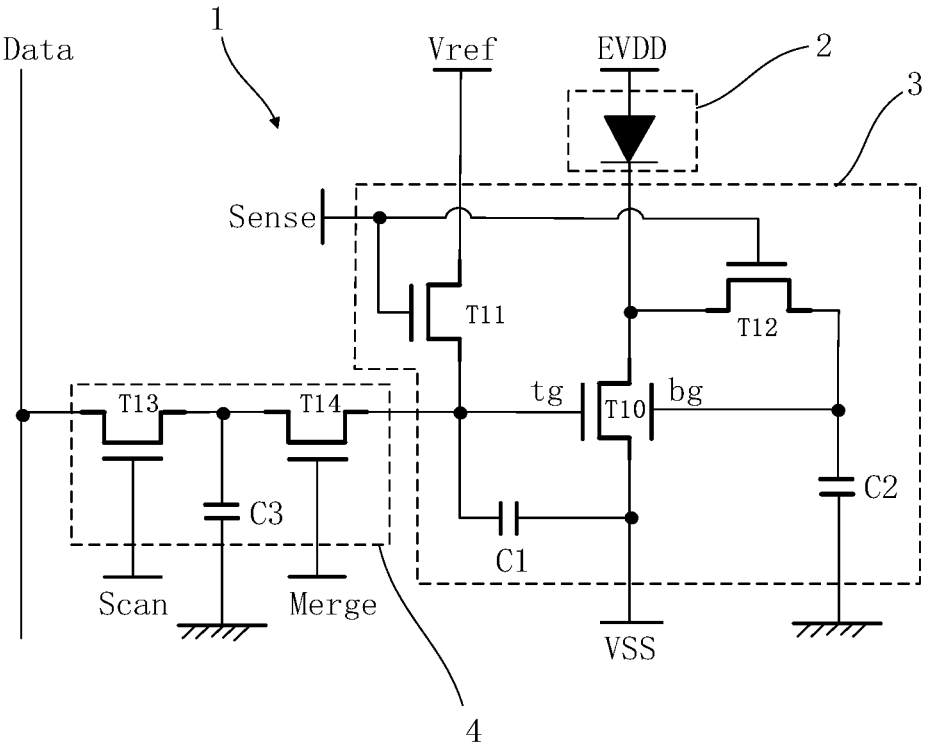
FIG. 5 is a circuit diagram of a pixel driving circuit of a 5T3C architecture provided by the embodiment of the present disclosure.

As shown in FIG. 2 and FIG. 5, the embodiment of the present disclosure further provides a pixel driving circuit 1 of a 5T3C architecture, and a difference from the above embodiment is that the data writing module 4 is configured to output a pre-stored data signal Data to the compensation driving module 3 in the data writing stage, and obtain and store a data signal needed for a next frame in the light-emitting module 2. Specifically, the data writing module 4 comprises the third switch thin film transistor T13, a fourth switch thin film transistor T14, and a third capacitor C3. the gate of the third switch thin film transistor T13 receives the second control signal Scan, the source of the third switch thin film transistor T13 receives the data signal Data, and the drain of the third switch thin film transistor T13 is electrically connected to a source of the fourth switch thin film transistor T14. A gate of the fourth switch thin film transistor T14 receives a third control signal Merge, and a drain of the fourth switch thin film transistor T14 is electrically connected to the top gate tg of the doubled-gate driving thin film transistor T10. One end of the third capacitor C3 is electrically connected to the source of the fourth switch thin film transistor T14, and the other end of the third capacitor C3 is grounded, which is configured to pre-store the data signal Data in a last frame.

The data writing module 4 is specifically configured to turn off the third switch thin film transistor T13 and the fourth switch thin film transistor T14 in the initial stage and the threshold voltage compensation stage. The data writing module 4 turns off the third switch thin film transistor T13 and turns on the fourth switch thin film transistor T14 in the data writing stage, which outputs a data signal Data pre-stored in the third capacitor C3 to the top gate tg of the doubled-gate driving thin film transistor T10. The data writing module 4 turns off the fourth switch thin film transistor T14 and turns on the third switch thin film transistor T13, which obtains the data signal of the next frame and store thereof in the third capacitor C3 in the light-emitting stage.

Specifically, the first switch thin film transistor T11, the second switch thin film transistor T12, the third switch thin film transistor T13, and the fourth switch thin film transistor T14 may be either N-type thin film transistors or P-type thin film transistors. According to different material types, the first switch thin film transistor T11, the second switch thin film transistor T12, the third switch thin film transistor T13, and the fourth switch thin film transistor T14 comprise one of an oxide thin film transistor, a low temperature polysilicon thin film transistor, an amorphous silicon thin film transistor, or an organic thin film transistor. Moreover, the first switch thin film transistor T11, the second switch thin film transistor T12, the third switch thin film transistor T13, and the fourth switch thin film transistor T14 may be either a single gate structure or a doubled-gate structure, which is not limited here.

It should be noted that a position of the source of the first switch thin film transistor T11 in FIG. 5 indicates the reference voltage Vref, which can also be replaced by the above high potential signal.

Figure 6:
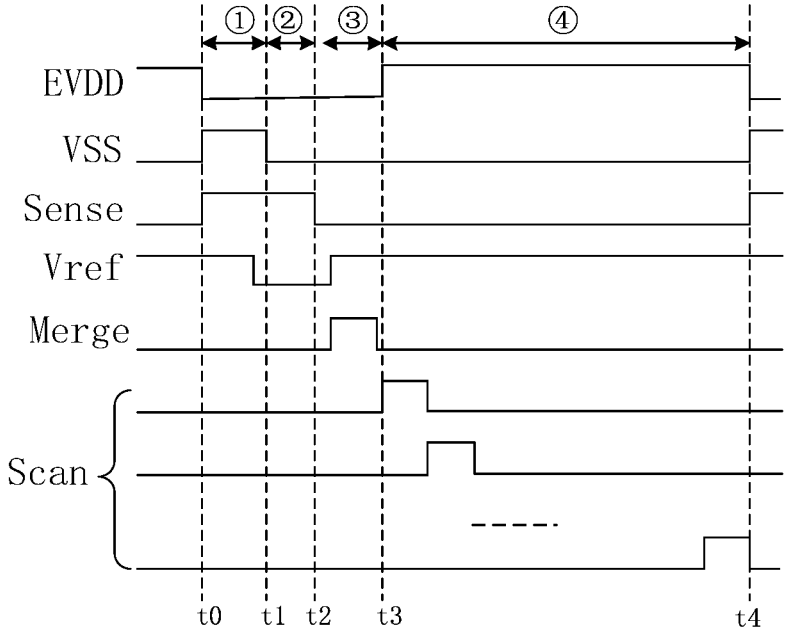
FIG. 6 is a driving timing diagram of the pixel driving circuit provided in FIG. 5.

In one embodiment, a driving timing of the pixel driving circuit 1 is shown in FIG. 6, the driving timing of the pixel driving circuit 1 is the initial stage (1), the threshold voltage compensation stage (2), the data writing stage (3), and the light-emitting stage (4) in sequence. It should be noted that since the source of the first switch thin film transistor T11 receives both the high potential signal in the initial stage (1) and the reference voltage Vref in the threshold voltage compensation stage (2), in the timing diagram, the high potential signal and the reference voltage Vref are indicated by a same potential line Vref, and the high potential signal is considered to be an initial voltage, the reference voltage Vref is considered to be a specific reference voltage in the compensation stage.

Combined FIG. 5 and FIG. 6, driving steps of the pixel driving circuit 1 are as follows:

The initial stage: the first power source voltage EVDD is a low potential, the second power source voltage VSS is a high potential, the first control signal Sense is a high potential, the first switch thin film transistor T11 and the second switch thin film transistor T12 are turned on, the second control signal Scan is a low potential, the third switch thin film transistor T13 is turned off, the third control signal Merge is a low potential, and the fourth switch thin film transistor T14 is turned off. The top gate tg of the doubled-gate driving thin film transistor T10 receives a high potential signal, so that the doubled-gate driving thin film transistor T10 is turned on, and the bottom gate bg and the drain of the doubled-gate driving thin film transistor T10 are short-circuited to form a diode structure. The second power source voltage VSS of the high potential charges the bottom gate bg of the doubled-gate driving thin film transistor T10 to a high potential. When the second power source voltage VSS drops from a high potential to a low potential, the threshold voltage Vth is adjusted to the lower initial value, and the second capacitor C2 stores the high potential of the bottom gate bg of the doubled-gate driving thin film transistor T10.

The threshold voltage compensation stage (2): the first power source voltage EVDD is a low potential, the second power source voltage VSS is a low potential, the first control signal Sense is a high potential, the first switch thin film transistor T11 and the second switch thin film transistor T12 are turned on, the second control signal Scan is a low potential, the third switch thin film transistor T13 is turned off, the third control signal Merge is a low potential, and the fourth switch thin film transistor T14 is turned off. The top gate tg of the doubled-gate driving thin film transistor T10 receives the reference voltage Vref, so that the doubled-gate driving thin film transistor T10 is turned on, and the bottom gate bg and the drain of the doubled-gate driving thin film transistor T10 are short-circuited to form a diode structure. The high potential of the bottom gate bg of the doubled-gate driving thin film transistor T10 gradually decreases until the doubled-gate driving thin film transistor T10 is turned off (cut off) that completes the compensation of the threshold voltage Vth. Moreover, the compensated threshold voltage Vth=Vref−VSS=Vref−0V=Vref, the second capacitor C2 stores a low potential of the bottom gate bg to maintain the threshold voltage Vth as a compensation value.

The data writing stage (3): the first power source voltage EVDD is a low potential, the second power source voltage VSS is a low potential, the first control signal Sense is a low potential, the first switch thin film transistor T11 and the second switch thin film transistor T12 are turned off, the second control signal Scan is a low potential, and the third switch thin film transistor T13 is turned off, the third control signal Merge is a high potential, and the fourth switch thin film transistor T14 is turned on. The data signal Data pre-stored in the third capacitor C3 output to the top gate tg of the doubled-gate driving thin film transistor T10 through the fourth switch thin film transistor T14, and stored in the first capacitor C1.

The light-emitting stage (4): the first power source voltage EVDD is a high potential, the second power source voltage VSS is a low potential, the first control signal Sense is a low potential, the first switch thin film transistor T11 and the second switch thin film transistor T12 are turned off, the second control signal Scan is a high potential, and the third switch thin film transistor T13 is turned on, the third control signal Merge is a low potential, and the fourth switch thin film transistor T14 is turned off. The data signal Data stored in the first capacitor C1 controls the doubled-gate driving thin film transistor T10 to be turned on to drive the light-emitting module 2 to emit light. Meanwhile, the second control signal Scan progressively turns on the third switch thin film transistor T13 in rows to write and store the data signal Data of the next frame from the data line into the third capacitor C3.

Specifically, in the light-emitting stage, the formula for current passing through the light-emitting devices is:

$$I = K(\alpha V_{Data} - Vth)^2$$
$$= K(\alpha V_{Data} - Vref)^2$$

Wherein, K is a constant coefficient related to characteristics of the doubled-gate driving thin film transistor T10, α is efficiency of the data signal Data transmitted to the top gate tg of the doubled-gate driving thin film transistor T10, and Vref is the reference voltage in the threshold voltage compensation stage.

According to the above current formula, a current value passing through the doubled-gate driving thin film transistor T10 and the light-emitting module 2 is independent of the threshold voltage Vth of the doubled-gate driving thin film transistor T10, and a threshold voltage drift of the doubled-gate driving thin film transistor T10 is compensated, which is beneficial to improve display uniformity and display accuracy of display panels.

It should be noted that in order to prevent the second power voltage VSS from dropping from a high potential to a low potential at a t1 time point causing a decrease in the high potential in the second capacitor C2, the high potential signal of the top gate tg of the doubled-gate driving thin film transistor T10 drops earlier than the second power source voltage VSS to turn off the doubled-gate driving thin film transistor T10 to maintain an initial effect. Moreover, in order to ensure that the compensated threshold voltage is not affected, the reference voltage Vref is delayed until it rises to a high potential signal in the data writing stage, which prevent simultaneously changing with the first control signal Sense at a t2 time.

In the present embodiment, in one aspect, the pixel driving circuit 1 of the 5T3C architecture can realize the compensation for the threshold voltage Vth being positive and negative, effectively broadening a compensation range of the threshold voltage Vth, which solves the problem that traditional diode-connect type internal compensation circuit can only compensate for the threshold voltage drift in a single direction, and is beneficial to improve display accuracy and display uniformity of the display panels and lifespan of the display panels. In the other aspect, the data writing module 4 in the present embodiment has a function of pre-storing the data signal Data, that is, in the light-emitting stage, the light-emitting devices can also write and store the data signal of the next frame while emitting light, which can effectively reduce time required for the data writing stage (t3 to t2), thereby increasing a duty cycle of the light-emitting stage (time required for the light-emitting stage/the total time required for the data writing stage and the light-emitting stage). Meanwhile, time for writing data signals is increased, charging time of high-resolution display panels is improved, which is beneficial to improve display effect of high-resolution display panels.

It should be noted that functions of the source and drain mentioned in all the above embodiments are the same, and names of the two can be interchanged, that is, when the thin film transistor is turned on, current can flow from the source to the drain, or from the drain to the source, and current flow is determined only by voltages of the source and drain.

Figure 7:
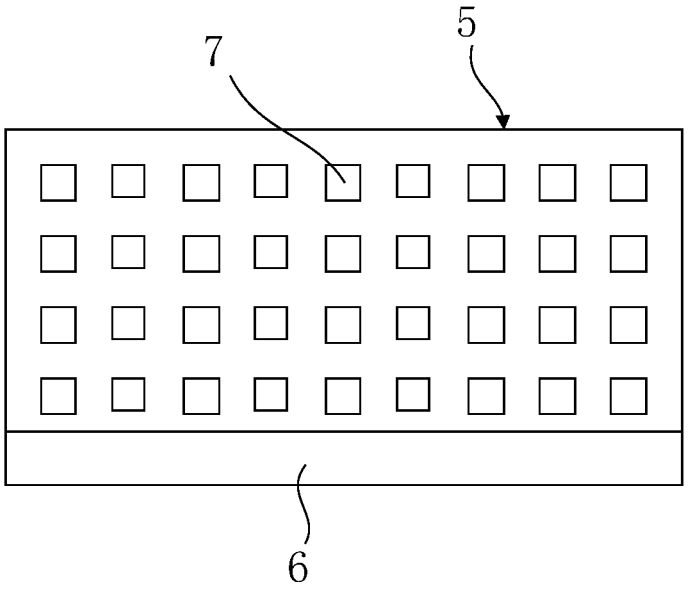
FIG. 7 is a schematic structural diagram of a display panel provided by the embodiment of the present disclosure.

As shown in FIG. 7, the embodiment of the present disclosure further provides a display panel 5, the display panel 5 comprises signal control unit 6 and a plurality of pixel units 7, each pixel units comprises any pixel driving circuit 1 in the above embodiment, and the signal control unit 6 is electrically connected to each pixel driving circuits 1 to provide a control signal for the pixel driving circuit 1.

Specifically, the display panel 5 comprises one of a low temperature poly-silicon (LTPS) display panel or an indium gallium zinc oxide (IGZO) display panel. Moreover, a type of the display panel 5 in the present embodiment is not limited herein.

Specifically, LTPS cannot be used in mass production of large-size OLED panels due to large size, poor uniformity, and high cost. The IGZO-based oxide semiconductor is suitable for mass production of large-size OLED panels due to high mobility, good uniformity in large-scale preparation, flexibility, and transparency. However, oxide TFTs have reliability problems. When TFTs are used as driving transistors, TFTs need to work under voltage/current stress, and a change in threshold voltage Vth will affect accuracy of images displayed. The pixel driving circuit 1 provided by the embodiment of the present disclosure is suitable for an OLED/micro-LED display panel 5 based on oxide TFT backplane technology, N-type driving TFT of doubled-gate structure realizes the compensation of the threshold voltage Vth, which can improve display uniformity of the panels, and can realize a compensation ability of the threshold voltage Vth when the threshold voltage Vth is positive and negative.

In the present embodiment, the pixel driving circuit 1 can realize the compensation for the threshold voltage being positive and negative, effectively broadening a compensation range of the threshold voltage, which solves the problem that traditional diode-connect type internal compensation circuit can only compensate for the threshold voltage drift in a single direction, and is beneficial to improve display accuracy and display uniformity of the display panels and lifespan of the display panels.

It should be noted that, for the pixel driving circuit 1 of the 5T3C architecture provided by the embodiments of the present disclosure, the first control signal Sense (transmitted signals by Sense lines) and the third control signal Merge (transmitted signals by Merge lines) are global signals, that is, the Sense lines of all the pixel units 7 on the display panel 5 are connected through a peripheral shorting bar, and the signal is provided by an external IC chip. Moreover, the Merge lines of all the pixel units 7 on the display panel 5 are also connected through a peripheral shorting bar, and the signal is provided by the external IC chip. For the pixel driving circuit 1 of the 4T2C architecture provided by the embodiments of the present disclosure, all Sense lines on the display panel 5 are also connected through a peripheral shorting bar, and the signal is provided by the external IC chip. Therefore, only the second control signal Scan is generated progressively, and generated by a gate signal driving IC or gate on array (GOA). If the second control signal Scan is generated by the gate signal driving IC, the number of signal channels is beneficial to be reduced, thereby reducing costs. If only the second control signal Scan is generated by GOA, a design complexity of GOA is reduced. GOA only needs to output Scan signals, which is beneficial to improve product yield, reduce a width of the display panel 5, and improve product competitiveness.

In the above embodiments, description of each embodiment has its own emphasis. For a part that is not detailed in an embodiment, you can refer to the related descriptions of other embodiments.

The pixel driving circuit and the display panel provided by the embodiments of the present disclosure have been described in detail above. The present disclosure uses specific examples to describe principles and embodiments of the present disclosure. The descriptions of the above embodiments are only used to help understand technical solutions of the present disclosure and core ideas thereof. Moreover, those of ordinary skill in the art should understand that the technical solutions described in the aforesaid embodiments can still be modified, or have some technical features equivalently replaced. However, these modifications or replacements do not depart from a scope of the technical solutions of the embodiments of the present disclosure.

What is claimed is:

1. A pixel driving circuit, comprising a light-emitting module and a compensation driving module, wherein the light-emitting module is configured to receive a first low power source voltage (EVDD) in an initial stage, a threshold voltage compensation stage, and a data writing stage; the light-emitting module receives a first high power source voltage (EVDD) in a light-emitting stage; the compensation driving module is electrically connected to the light-emitting module, comprises a doubled-gate driving thin film transistor (T10), and is configured to receive a high potential signal to turn on the doubled-gate driving thin film transistor (T10), and receive a second high power source voltage (VSS) to charge a bottom gate of the doubled-gate driving thin film transistor (T10) to adjust a threshold voltage (Vth) of the doubled-gate driving thin film transistor (T10) to an initial value in the initial stage; the compensation driving module receives a reference voltage (Vref) to turn on the doubled-gate driving thin film transistor (T10), and receives a second low power source voltage (VSS) to discharge the bottom gate of the doubled-gate driving thin film transistor (T10), and compensates the threshold voltage (Vth) of the doubled-gate driving thin film transistor (T10) to be equal to a voltage difference between the reference voltage (Vref) and the second low power source voltage (VSS) in the threshold voltage compensation stage; the compensation driving module receives a data signal (Data) and the second low power source voltage (VSS) in the data writing stage; and the doubled-gate driving thin film transistor (T10) is turned on, and the compensation driving module receives the second low power source voltage (VSS) to control the light-emitting module to emit light in the light-emitting stage.

2. The pixel driving circuit as claimed in claim 1, wherein the compensation driving module comprises a first switch thin film transistor (T11) and a second switch thin film transistor (T12); the compensation driving module is further configured to turn on the first switch thin film transistor (T11) to receive the high potential signal, and turn on the second switch thin film transistor (T12) so that the second high power source voltage (VSS) charges the bottom gate of the doubled-gate driving thin film transistor (T10) in the initial stage; the compensation driving module turns on the first switch thin film transistor (T11) to receive the reference voltage, and turns on the second switch thin film transistor (T12) to discharge the bottom gate of the doubled-gate driving thin film transistor (T10) in the threshold voltage compensation stage; the compensation driving module turns off the first switch thin film transistor (T11) and the second switch thin film transistor (T12) to receive the data signal in the data writing stage; and the compensation driving module turns off the first switch thin film transistor (T11) and the second switch thin film transistor (T12) to drive the second switch thin film transistor (T12) to emit light in the light-emitting stage.

3. The pixel driving circuit as claimed in claim 2, wherein a source of the doubled-gate driving thin film transistor (T10) receives the second high power source voltage (VSS) in the initial stage and receives the second low power source voltage (VSS) in the threshold voltage compensation stage, and the data writing stage and the light-emitting stage, and a drain of the doubled-gate driving thin film transistor (T10) is electrically connected to the light-emitting module; a gate of the first switch thin film transistor (T11) receives a first control signal, a source of the first switch thin film transistor (T11) receives the high potential signal in the initial stage and receives the reference voltage (Vref) in the threshold voltage compensation stage, and a drain of the first switch thin film transistor (T11) is electrically connected to a top gate of the doubled-gate driving thin film transistor (T10); and a gate of the second switch thin film transistor (T12) receives the first control signal, a source of the second switch thin film transistor (T12) is electrically connected to the drain of the doubled-gate driving thin film transistor (T10), and a drain of the second switch thin film transistor (T12) is electrically connected to the bottom gate of the doubled-gate driving thin film transistor (T10).

4. The pixel driving circuit as claimed in claim 3, wherein the compensation driving module comprises a first capacitor (C1) and a second capacitor (C2); one end of the first capacitor (C1) is electrically connected to the top gate of the doubled-gate driving thin film transistor (T10), and the other end of the first capacitor (C1) is electrically connected to the source of the doubled-gate driving thin film transistor (T10), which are configured to store a potential of the top gate of the doubled-gate driving thin film transistor (T10); and one end of the second capacitor (C2) is electrically connected to the bottom gate of the doubled-gate driving thin film transistor (T10), and the other end of the second capacitor (C2) is grounded, which are configured to store a potential of the bottom gate of the doubled-gate driving thin film transistor (T10).

5. The pixel driving circuit as claimed in claim 4, wherein the pixel driving circuit comprises a data writing module electrically connected to the compensation driving module; the data writing module is configured to output a pre-stored data signal to the compensation driving module in the data writing stage, and to obtain and store the data signal needed for a next frame in the light-emitting stage.

6. The pixel driving circuit as claimed in claim 5, wherein the data writing module comprises a third switch thin film transistor (T13), a fourth switch thin film transistor (T14), and a third capacitor (C3); the data writing module is configured to turn off the third switch thin film transistor (T13), turn on the fourth switch thin film transistor (T14), and output the pre-stored data signal in the third capacitor (C3) to the top gate of the doubled-gate driving thin film transistor (T10) in the data writing stage; and the data writing module turns off the fourth switch thin film transistor (T14) and turns on the third switch thin film transistor (T13) to obtain the data signal of the next frame and store thereof in the third capacitor (C3) in the light-emitting stage.

7. The pixel driving circuit device as claimed in claim 6, wherein a gate of the third switch thin film transistor (T13) receives a second control signal, a source of the third switch thin film transistor (T13) receives the data signal and a drain of the third switch thin film transistor (T13) is electrically connected to a source of the fourth switch thin film transistor (T14); a gate of the fourth switch thin film transistor (T14) receives a third control signal, and a drain of the fourth switch thin film transistor (T14) is electrically connected to the top gate of the doubled-gate driving thin film transistor (T10); and one end of the third capacitor (C3) is electrically connected to the source of the fourth switch thin film transistor (T14), and the other end of the third capacitor (C3) is grounded.

8. The pixel driving circuit device as claimed in claim 7, wherein each of the first switch thin film transistor (T11), the second switch thin film transistor (T12), the third switch thin film transistor (T13), and the fourth switch thin film transistor (T14) is one of an N-type thin film transistor or a P-type thin film transistor.

9. The pixel driving circuit as claimed in claim 3, wherein the pixel driving circuit comprises a data writing module electrically connected to the compensation driving module; and the data writing module is configured to obtain the data signal and output the data signal to the compensation driving module in the data writing stage.

10. The pixel driving circuit as claimed in claim 9, wherein the data writing module comprises a third switch thin film transistor (T13), a gate of the third switch thin film transistor (T13) receives a second control signal, a source of the third switch thin film transistor (T13) receives the data signal and a drain of the third switch thin film transistor (T13) is electrically connected to the top gate of the doubled-gate driving thin film transistor (T10).

11. The pixel driving circuit as claimed in claim 10, wherein each of the first switch thin film transistor (T11), the second switch thin film transistor (T12), and the third switch thin film transistor (T13) is one of an N-type thin film transistor or a P-type thin film transistor.

12. The pixel driving circuit as claimed in claim 1, wherein the reference voltage (Vref) is a positive voltage or a negative voltage.

13. The pixel driving circuit as claimed in claim 1, wherein the doubled-gate driving thin film transistor (T10) is one of an N-type oxide thin film transistor, an N-type low-temperature polysilicon thin film transistor, an N-type amorphous silicon thin film transistor, or an N-type organic thin film transistor.

14. The pixel driving circuit as claimed in claim 1, wherein the light-emitting module comprises an organic light-emitting diode (OLED) light-emitting device or a micro light-emitting diode (micro-LED) light-emitting device.

15. A display panel, comprising a signal control unit and a plurality of pixel units, wherein each pixel units comprises the pixel driving circuit as claimed in claim 1; and the signal control unit is electrically connected to each pixel driving circuits to provide a control signal for the pixel driving circuit.

16. The display panel as claimed in claim 15, wherein the compensation driving module comprises a first switch thin film transistor (T11) and a second switch thin film transistor (T12), the compensation driving module is further configured to turn on the first switch thin film transistor (T11) to receive the high potential signal, and turn on a second switch thin film transistor (T12) so that the second high power source voltage (VSS) charges the bottom gate of the doubled-gate driving thin film transistor (T10) in the initial stage; the compensation driving module turns on the first switch thin film transistor (T11) to receive a reference voltage, and turns on the second switch thin film transistor (T12) to discharge the bottom gate of the doubled-gate driving thin film transistor (T10) in the threshold voltage compensation stage; the compensation driving module turns off the first switch thin film transistor (T11) and the second switch thin film transistor (T12) to receive the data signal in the data writing stage; and the compensation driving module turns off the first switch thin film transistor (T11) and the second switch thin film transistor (T12) to drive the second switch thin film transistor (T12) to emit light in the light-emitting stage.

17. The display panel as claimed in claim 16, wherein a source of the doubled-gate driving thin film transistor (T10) receives the second high power source voltage (VSS) in the initial stage and receives the second low power source voltage (VSS) in the threshold voltage compensation stage, and the data writing stage and the light-emitting stage, and a drain of the doubled-gate driving thin film transistor (T10) is electrically connected to the light-emitting module; a gate of the first switch thin film transistor (T11) receives a first control signal, a source of the first switch thin film transistor (T11) receives the high potential signal in the initial stage and receives the reference voltage (Vref) in the threshold voltage compensation stage, and a drain of the first switch thin film transistor (T11) is electrically connected to a top gate of the doubled-gate driving thin film transistor (T10); and a gate of the second switch thin film transistor (T12) receives the first control signal, a source of the second switch thin film transistor (T12) is electrically connected to the drain of the doubled-gate driving thin film transistor (T10), and a drain of the second switch thin film transistor (T12) is electrically connected to the bottom gate of the doubled-gate driving thin film transistor (T10).

18. The display panel as claimed in claim 17, wherein the compensation driving module comprises a first capacitor (C1) and a second capacitor (C2); one end of the first capacitor (C1) is electrically connected to the top gate of the doubled-gate driving thin film transistor (T10), and the other end of the first capacitor (C1) is electrically connected to the source of the doubled-gate driving thin film transistor (T10), which are configured to store a potential of the top gate of the doubled-gate driving thin film transistor (T10); and one end of the second capacitor (C2) is electrically connected to the bottom gate of the doubled-gate driving thin film transistor (T10), and the other end of the second capacitor (C2) is grounded, which are configured to store a potential of the bottom gate of the doubled-gate driving thin film transistor (T10).

19. The display panel as claimed in claim 15, wherein the pixel driving circuit comprises a data writing module electrically connected to the compensation driving module; the data writing module is configured to output a pre-stored data signal to the compensation driving module in the data writing stage, and to obtain and store a data signal needed for a next frame in the light-emitting stage.

20. The display panel as claimed in claim 15, wherein the reference voltage (Vref) is a positive voltage or a negative voltage.

* * * * *